US005267009A

United States Patent [19]

Takada et al.

[11] Patent Number: 5,267,009

[45] Date of Patent: Nov. 30, 1993

[54] COPYING MACHINE INCLUDING MEANS FOR MAKING COPIES THE SAME LENGTH

[75] Inventors: Akihiro Takada, Sennan; Akihiro Kondo, Izumi, both of Japan

[73] Assignee: Mita Industrial Co., Ltd., Osaka, Japan

[21] Appl. No.: 892,046

[22] Filed: Jun. 2, 1992

[30] Foreign Application Priority Data

Jun. 27, 1991 [JP] Japan ..... 3-156973

[51] Int. Cl.[5] ..... G03G 21/00

[52] U.S. Cl. ..... 355/310; 271/225; 355/308

[58] Field of Search ..... 355/308, 309, 310, 311, 355/203, 204, 77, 208; 271/225

[56] References Cited

U.S. PATENT DOCUMENTS

| | | | |
|---|---|---|---|
| 4,126,389 | 11/1978 | Ikeda et al. | 355/310 |
| 4,193,330 | 3/1980 | Knox | 355/310 X |
| 5,081,489 | 1/1992 | Ishikawa et al. | 355/311 X |
| 5,132,741 | 7/1992 | Kitajima et al. | 355/309 |

*Primary Examiner*—A. T. Grimley

*Assistant Examiner*—Sandra L. Brasé

*Attorney, Agent, or Firm*—Beveridge, DeGrandi, Weilacher & Young

[57] ABSTRACT

A document is conveyed by switching the direction in which the document is conveyed to a forward direction or a reverse direction by a document conveying section, thereby to make a plurality of copies from the same document. An image forming operation with illuminating and scanning by a light source is performed when the document is conveyed in the forward direction. A copy image is formed on rolled-paper suitably cut by a cutter. In a case where a plurality of copies are made, when the document is conveyed in the forward direction so as to make the first copy, the time elapsed from the start of the copying operation until the synchro sensor senses a rear end of the document is measured. The time measured is stored in a memory. The timing at which the rolled-paper is cut in operations of making the second and subsequent copies is set on the basis of the time stored in the memory. This construction makes it possible to make the lengths of copy paper sheets obtained by cutting the rolled-paper equal to each other when a plurality of copies are made.

9 Claims, 5 Drawing Sheets

COPYING MACHINE INCLUDING MEANS FOR MAKING COPIES THE SAME LENGTH

BACKGROUND OF THE INVENTION

1. Field of the Invention

The present invention relates to a copying machine so adapted as to convey a document to illuminate and scan the surface of the document and record a copy image of the document on strip-shaped continuous copy paper such as rolled-paper.

2. Description of the Prior Art

In an electrostatic process copying machine conventionally widely used, a copy image of a document is formed on copy paper in the following manner. The document is illuminated and scanned, and a photoreceptor is exposed to reflected light from the document. Consequently, an electrostatic latent image is formed on the surface of the photoreceptor. The electrostatic latent image is developed into a toner image, and the toner image is heated and fixed to the copy paper. Therefore, the copy image of the document is formed on the copy paper.

Examples of such an electrostatic process copying machine recently provided include one capable of copying a document of large size such as 0-th of series A in Japanese Industrial Standard (hereinafter referred to as "A0 size"). "A0 size" refers to one of finished sizes of paper under Japanese Industrial Standard, that is, 841 (mm)×1189 (mm). In a copying machine capable of copying such a document of large size, the document is illuminated and scanned by conveying the document with an optical system being fixed. On the other hand, it is difficult to handle copy paper sheets of large size such as A0 size one at a time. Accordingly, rolled-paper which is stripshaped continuous copy paper wound in a roll shape may, in some cases, be applied to the copy paper sheets.

A so-called synchro sensor for sensing a rear end of a document to sense the length of the document is provided in a document conveying path. The timing at which rolled-paper is cut is set on the basis of the timing at which the synchro sensor senses the rear end of the document, thereby to make it possible to cut the rolled-paper to lengths corresponding to the size of the document.

In the above described copying machine, when a plurality of copies are made from one document, the document is conveyed by repeatedly moving back and forth in the document conveying path. More specifically, when the document is conveyed in a forward direction which is one direction in which the document is conveyed, an image forming operation with illuminating and scanning of a document is performed. When the document is conveyed in a reverse direction which is the other direction in which the document is conveyed, the image forming operation is not performed but the document is only conveyed.

When the document is conveyed in the forward direction, the rear end of the document is sensed by the above described synchro sensor, and the timing at which the rolled-paper is cut is set each time.

In the above described construction, however, when a plurality of copies are made, the rear end of the document is sensed by the synchro sensor for each copying operation, and the timing at which the rolled-paper is cut is set on the basis of a sensing output of the synchro sensor. Accordingly, the lengths of copy paper sheets obtained by the cutting slightly vary due to a sensing error in the synchro sensor. Consequently, the lengths of the copy paper sheets each having a copy image of the document formed thereon vary, resulting in a poor appearance.

SUMMARY OF THE INVENTION

An object of the present invention is to solve the above described problems and to provide a copying machine capable of cutting strip-shaped continuous copy paper to constant lengths to make the lengths of respective copy paper sheets obtained by the cutting equal to each other when a plurality of copies are made.

In the present invention, when a plurality of copies are made from the same document, the length of the document is sensed and stored in a memory when the document is first conveyed in a forward direction. The timing at which the continuous copy paper delivered in synchronization with the conveyance of the document is cut is set on the basis of the length of the document stored in the memory.

Therefore, when a plurality of copies are made by alternately switching the direction in which the document is conveyed to the forward direction or a reverse direction to convey the document in a document conveying path, the timing at which the continuous copy paper is cut in each copying operation can be made the same. As a result, the continuous copy paper can be cut to equal lengths.

Consequently, the lengths of the plurality of copy paper sheets each having an image formed thereon can be made equal to each other to keep up the good appearance.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments will be described in detail with reference to the drawings.

Figure 1:
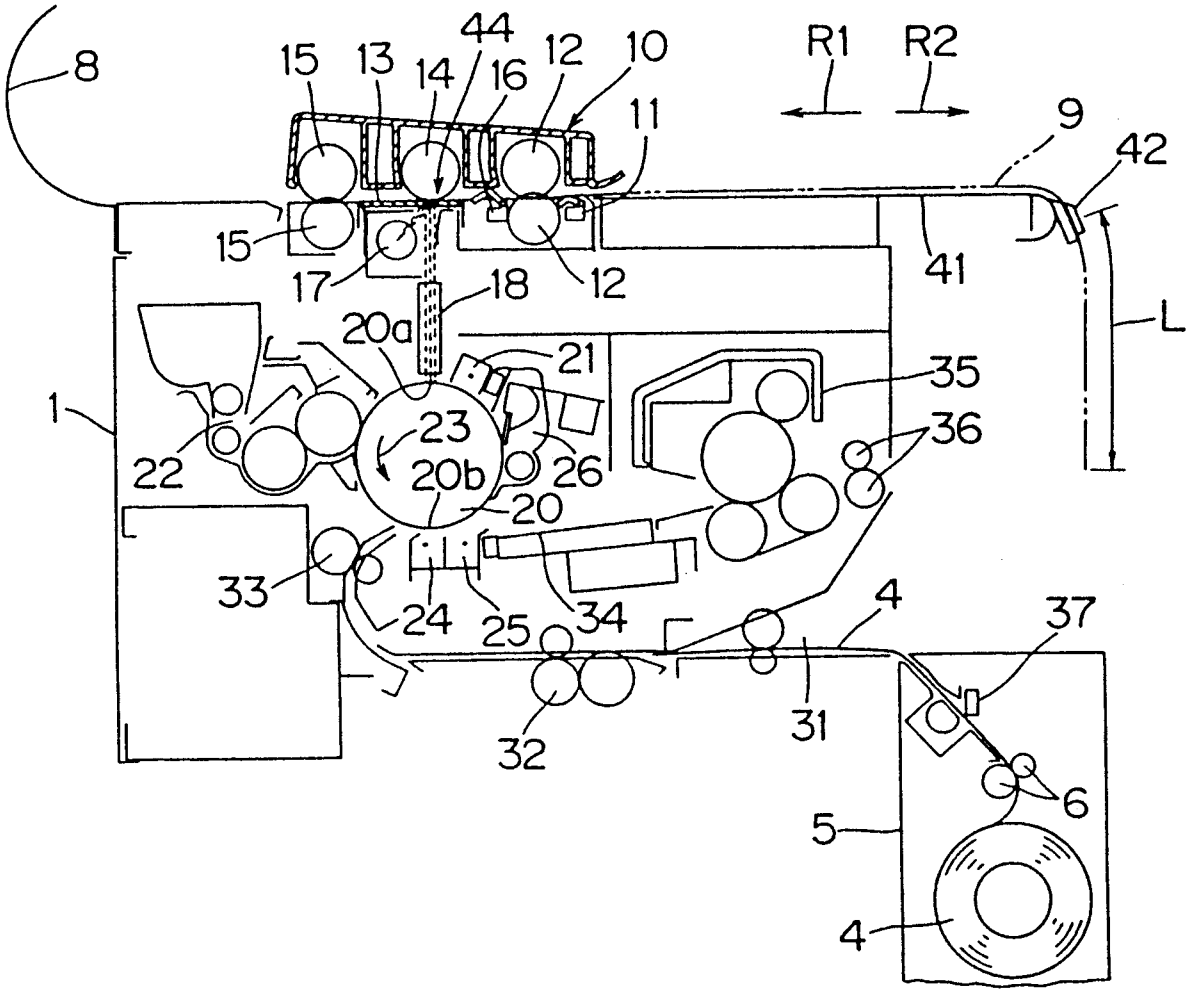
FIG. 1 is a cross sectional view showing the internal structure of a copying machine according to one embodiment of the present invention in a simplified manner.
Figure 2:
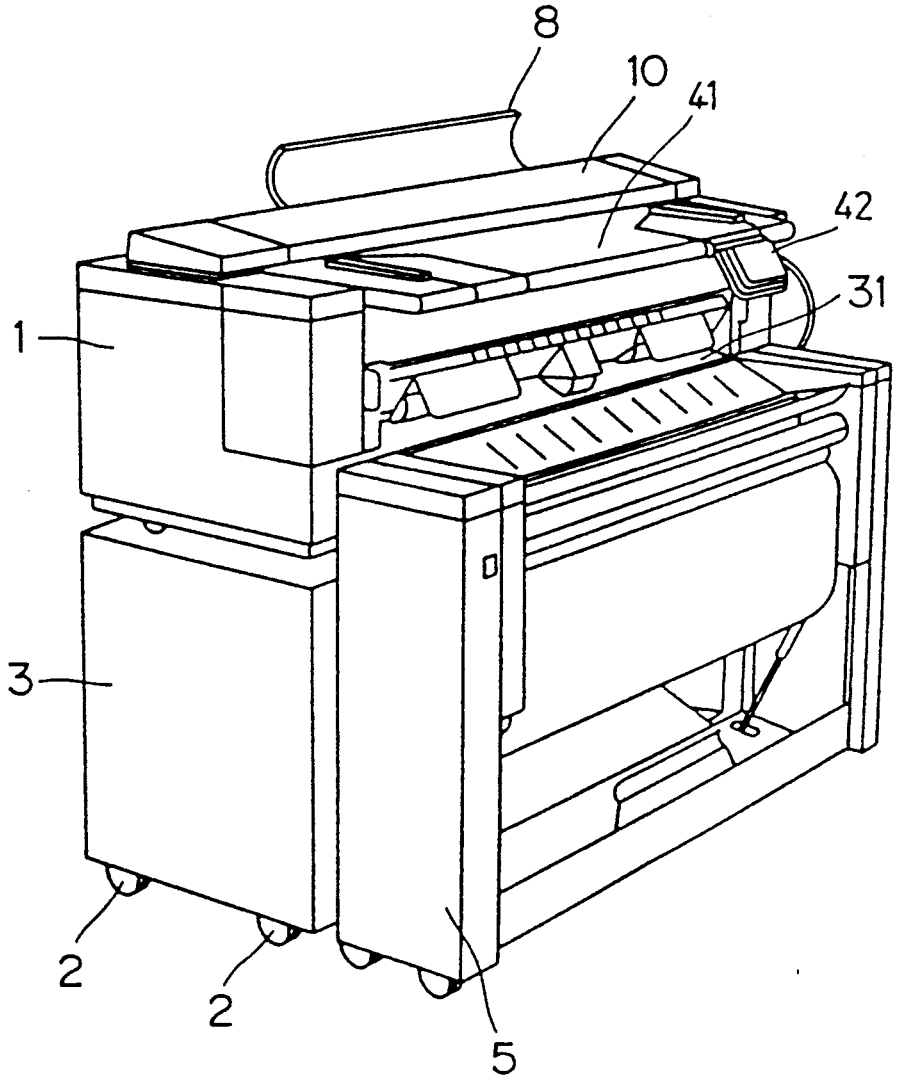
FIG. 2 is a perspective view showing the appearance of the copying machine.

FIG. 1 is a cross sectional view showing the internal structure of a copying machine according to one embodiment of the present invention in a simplified manner, and FIG. 2 is a perspective view showing the appearance of the copying machine. This copying machine is used for obtaining a copy image of a document of large size such as A0 size. In this copying machine, the document is conveyed, while the surface of the document is illuminated and scanned by an optical system fixedly arranged, to form an image on the basis of the illumination and scanning.

A main body of the copying machine 1 is carried by a movable deck 3 having caster wheels 2 provided in its bottom part. A rolled-paper feeding unit 5 for feeding rolled-paper 4 which is strip-shaped continuous copy paper is provided in relation to the movable deck 3. The rolled-paper 4 wound in a roll shape is contained in the rolled-paper feeding unit 5. The rolled-paper 4 is fed to a paper feeding path 31 in the main body 1 by a paper feeding roller 6.

A document conveying section 10 for switching the direction in which a document is conveyed to a forward direction R1 or a reverse direction R2 to convey the document 9 is provided in the upper part of the main body 1. An image forming operation is performed when the document 9 is conveyed in the forward direction R1. When a plurality of copies are made from the same document, the document conveying section 10 alternately switches the direction in which the document is conveyed between the forward direction R1 and the reverse direction R2 to convey the document 9.

The document conveying section 10 comprises a first delivery roller 12, a second delivery roller 14, and a third delivery roller 15. When a front end sensing switch 11 for sensing a front end of the document 9 is turned on, the first delivery roller 12 starts to be driven. The second delivery roller 14 is provided in a position opposed to a transparent plate 13 for making slit exposure of the document 9 and causes the document 9 to adhere to the transparent plate 13. The third delivery roller 15 discharges the document 9 after exposure.

A front end sensing switch 16 for sensing the front end of the document 9 (an end on the downstream side of the document 9 in the forward direction R1) when the document 9 is conveyed in the reverse direction R2 is disposed between the first and second delivery rollers 12 and 14. The front end sensing switch 16 is turned off, thereby to stop the driving of the delivery rollers 12, 14 and 15. At this time, there occurs a state where the front end of the document 9 is held by the delivery roller 12, to prepare for the next copying operation. Reference numeral 8 denotes a reversing member for reversing the direction of the document 9 to prevent the document 9 from dropping into the back of the main body 1.

A light source 17 serving as document scanning means for illuminating the surface of the document 9 is fixedly disposed in relation to the transparent plate 13. Light from the light source 17 is irradiated on the surface of the document 9 through the transparent plate 13. Light reflected from the surface of the document 9 is led to the surface of a photosensitive drum 20 provided in a substantially central part of the main body 1 by a Selfoc lens 18. The surface of the photosensitive drum 20 before being exposed to light from the Selfoc lens 18 is uniformly charged by a charging corona discharger 21.

Therefore, an electrostatic latent image corresponding to a document image is formed on the surface of the photosensitive drum 20 after being exposed. This electrostatic latent image is developed into a toner image by a developing device 22. The toner image is led to the vicinity of a transferring corona discharger 24 by the rotation of the photosensitive drum 20 in a direction indicated by an arrow 23.

On the other hand, the rolled-paper 4 led to a paper feeding path 31 is further led to the vicinity of the transferring corona discharger 24 by a delivery roller 32 and a registration roller 33. The toner image on the surface of the photosensitive drum 20 is transferred to the rolled-paper 4 by corona discharge in the transferring corona discharger 24. The rolled-paper 4 having the toner image transferred thereto is stripped from the surface of the photosensitive drum 20 by corona discharge in a separating corona discharger 25, and is further led to a fixing device 35 through a conveying path 34. In the fixing device 35, toner particles are fixed to the surface of the rolled-paper 4. The rolled-paper 4 having the toner particles fixed thereto is discharged into the outside of the main body 1 through a discharge roller 36. On the other hand, toner particles remaining on the surface of the photosensitive drum 20 after transferring the toner image are removed by a cleaning device 26, to prepare to form the next electrostatic latent image.

The above described paper feeding roller 6, the delivery roller 32, the registration roller 33, and the like constitute paper feeding means. In addition, the photosensitive drum 20, the developing device 22, the transferring corona discharger 24, and the like constitute image forming means.

Figure 3:
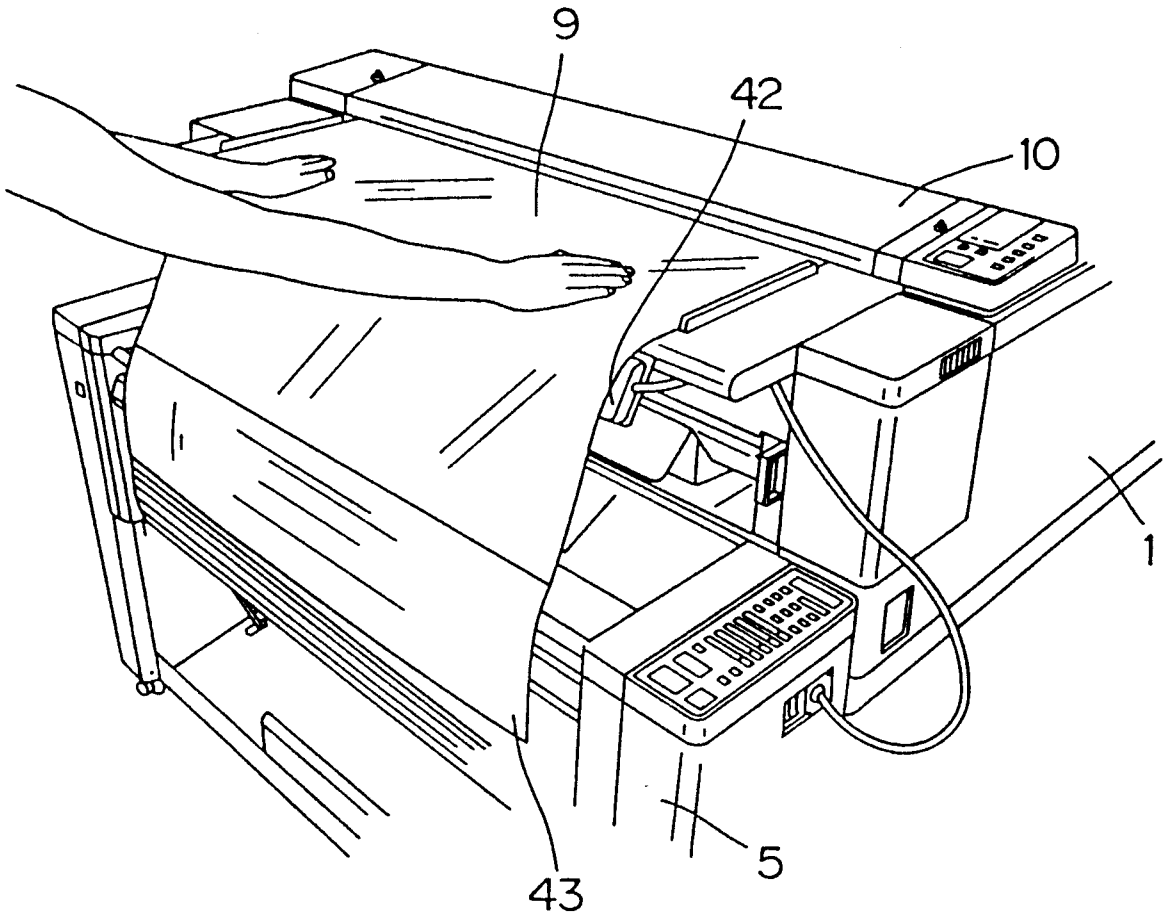
FIG. 3 is a perspective view showing a state where the copying machine is used.

A document conveying path 41 is formed to a position projected from the upper surface of the main body 1 on the upstream side of the document conveying section 10 in the forward direction R1. In an end of the document conveying path 41, a synchro sensor 42 is provided in one end in the direction of the width of the document 9. The synchro sensor 42 is used for sensing a rear end of the document 9 to set the timing at which the rolled-paper 4 is cut. At the time of copying, the document 9 is held by a carrier sheet 43 constituted by a pair of sheet members made of a transparent synthetic resin material so as to prevent the document 9 from being damaged at the time of conveyance, as can be seen from FIG. 3 showing a state where the copying machine is used. The synchro sensor 42 can sense the rear end of the document 9 in the carrier sheet 43.

Consider a case where one copy is made. In this case, when the synchro sensor 42 senses the rear end of the document 9, a cutter 37 is operated in the rolled-paper feeding unit 5 in response to the sensing, to cut the rolled-paper 4. The cutter 37 corresponds to cutting means. More specifically, in the present embodiment, the length of a paper feeding path of the rolled-paper 4 from the cutter 37 to the transferring corona discharger 24 is set to be larger than the length of a document feeding path from the synchro sensor 42 to a position for document exposure 44 by a length leading to a position for transfer **20*b* from a position for exposure 20*a* of the photosensitive drum 20. Consequently, if the cutter 37 is operated at the time point where the synchro sensor 42 senses the rear end of the document 9, an image corresponding to the rear end of the document 9** can be formed in a rear end of a copy paper sheet obtained by the cutting.

It is needless to say that the relation between the length of the document feeding path and the length of the paper feeding path of the rolled-paper 4 can be arbitrarily set. In this case, the timing at which the cutter 37 is operated may be suitably set on the basis of the timing at which the synchro sensor 42 senses the rear end of the document 9.

Figure 4:
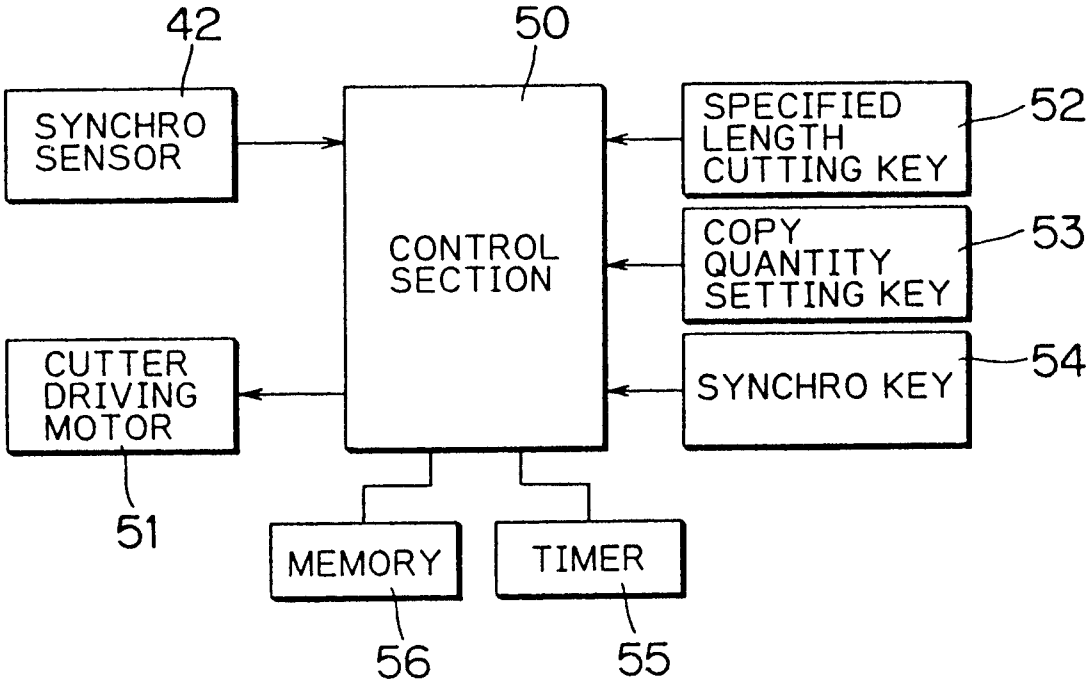
FIG. 4 is a block diagram showing the electrical construction of main parts of the copying machine.

FIG. 4 is a block diagram showing the electrical construction of the above described copying machine. The above described synchro sensor 42 and a cutter driving motor 51 for driving the cutter 37 are connected to a control section 50 comprising a CPU (central processing unit) and the like. In addition, a specified length cutting key 52 for cutting the rolled-paper 4 to previously specified lengths, a copy quantity setting key 53 for setting the number of copies, and a synchro key 54 for causing the synchro sensor 42 to sense the length of the document 9 to cut the rolled-paper 4 are connected to the control section 50. Furthermore, a timer 55 is connected to the control section 50. The timer 55 is initiated in response to the start of an operation of making the first copy when a plurality of copies are made and is used for measuring the time ΔT elapsed until the synchro sensor 42 senses the rear end of the document 9 at the time of making the first copy. The above described time ΔT measured by the timer 55 is stored in a memory 56 serving as storing means connected to the control section 50.

Since the document conveying section 10 conveys the document in the forward direction R1 at constant speed as the copying operation is started, the above described time ΔT corresponds to the length L shown in FIG. 1, that is, the length from the synchro sensor 42 to the rear end of the document 9 immediately before the start of the copying operation. However, the length from the synchro sensor 42 to the front end of the document 9 is constant irrespective of the length of the document 9. Therefore, the time ΔT stored in the memory 56 eventually corresponds to the length of the document 9. In the present embodiment, therefore, the synchro sensor 42, the timer 55, and the like constitute document length sensing means.

Figure 5:
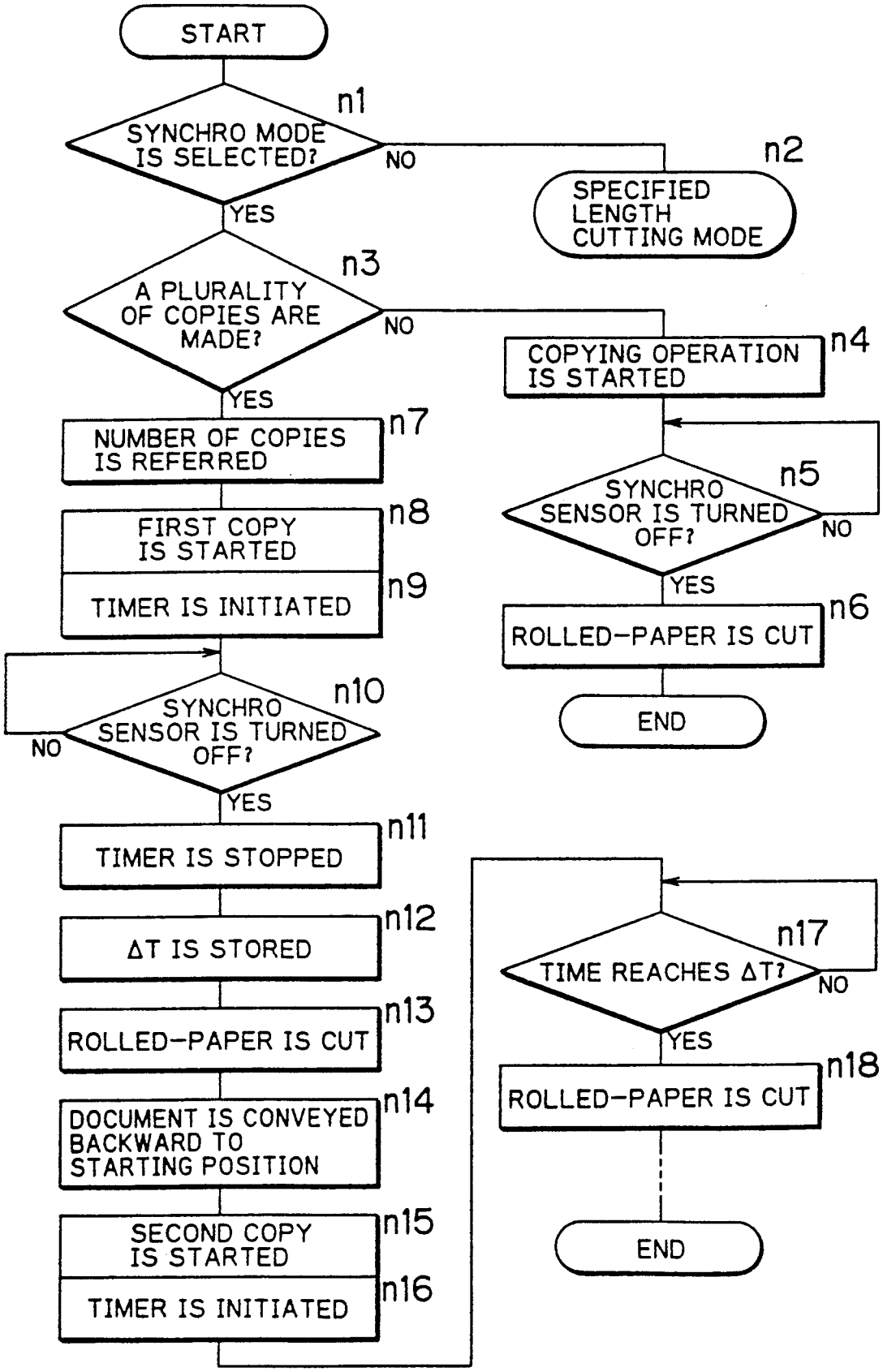
FIG. 5 is a flow chart for explaining the operation of the copying machine.

FIG. 5 is a flow chart for explaining a control operation in the control section 50. It is judged in the step n1 whether or not the synchro key 54 is turned on to select a synchro mode. If the synchro mode is not selected, a copying operation conforming to a specified length cutting mode is performed in the step n2. This specified length cutting mode is an operation mode for cutting the rolled-paper 4 to constant lengths irrespective of the length of the document 9.

When the synchro mode is selected, it is judged in the step n3 whether or not a plurality of copies are made. If a plurality of copies are not made, a single copy mode for performing an operation of making only one copy is selected in the step n4, so that the document conveying section 10 starts to convey the document 9 in the forward direction R1, to start a copying operation. At this time, the paper feeding roller 6, and the delivery roller 32, and the like are driven so as to be synchronized with the conveyance of the document 9, so that the rolled-paper 4 is fed to the vicinity of the transferring corona discharger 24.

The program waits in the step n5 until the synchro sensor 42 senses the rear end of the document 9 and is turned off. When the synchro sensor 42 is turned off, the cutter driving motor 51 is energized so that the rolled-paper 4 is cut by the cutter 37 in the step n6.

If it is judged in the step n3 that a plurality of copies are made, then the number of copies set by the copy quantity setting key 53 is referred in the step n7. An operation of making the first copy is then started in the step n8, and the timer 55 is initiated in the step n9. At this time, the document conveying section 10 conveys the document 9 in the forward direction R1, and the rolled-paper 4 is fed in synchronization with the conveyance.

The program waits in the step n10 until the synchro sensor 42 is turned off. When the synchro sensor 42 is turned off, the timer 55 is stopped in the step n11. In the step n12, the time ΔT measured by the timer 55 is stored in the memory 56. Furthermore, in the step n13, the cutter driving motor 51 is energized so that the rolled-paper 4 is cut, to terminate the operation of making the first copy.

In the step n14, the document 9 is conveyed in the reverse direction R2, to enter a state where the front end of the document 9 is held by the first delivery roller 12 in the document conveying section 10. That is, the document 9 is conveyed in the reverse direction R2 to the position where copying is started. In the step n15, the document conveying section 10 starts to convey the document 9 in the forward direction R1, to start an operation of making the second copy. The timer 55 is initiated in the step n16 as the copying operation is started. At this time, the rolled-paper 4 is fed in synchronization with the conveyance of the document 9, as in the operation of making the first copy.

In the step n17, the program waits until the time measured by the timer 55 reaches the above described time ΔT stored in the memory 56. When the time measured by the timer 55 reaches the time ΔT, the cutter driving motor 51 is energized at this time point so that the rolled-paper 4 is cut (step n18).

Thereafter, the same operations as those in the steps n14 to n18 are repeatedly performed, thereby to make a set number of copies.

When a plurality of copies are made by the above described processing in the control section 50, the timing at which the rolled-paper 4 is cut in operations of making the second and subsequent copies is set on the basis of the time ΔT stored in the memory 56. This time ΔT is the time, at the time of the operation of making the first copy, from the time when the copying operation is started to the time when the rolled-paper 4 is cut. Accordingly, copy paper sheets obtained by the cutting in the operations of making the second and subsequent copies and discharged from the main body of the copying machine 1 eventually have a length equal to the length of a copy paper sheet obtained by the cutting in the operation of making the first copy. In such a manner, when a plurality of copies are made, the rolled-paper 4 is cut to equal lengths. Accordingly, a copy image is formed on the copy paper sheets equal in length. Consequently, it is possible to keep up the good appearance.

The present invention is not limited to the above described embodiment. For example, although in the above described embodiment, the light reflected from the document 9 is led to the surface of the photosensitive drum 20 by the Selfoc lens 18, and the electrostatic latent image is formed on the surface of the photosensitive drum 20 by light from the Selfoc lens 18, the electrostatic latent image may be formed on the surface of the photosensitive drum 20 by receiving the light reflected from the document 9 by a light receiving element and providing exposing means such as an LED (light emitting diode) head so as to be opposed to the photosensitive drum 20, to drive the exposing means on the basis of an output of the light receiving element.

Furthermore, if thermographic paper is used as copy paper, a thermal head can be also used as image forming means.

Additionally, although in the above described embodiment, the length of the document 9 is sensed by measuring the time elapsed from the start of the copying operation until the rear end of the document 9 is sensed by the synchro sensor 42, the length of the document 9 can be obtained if the time from the time when the front end sensing switch 16 is turned on to the time when the front end sensing switch 16 is turned off is measured by the timer 55, for example. In addition, when there is provided a sufficiently long document conveying path to mount the document 9 over the entire length, the length of the document 9 can be directly measured in a state where the document 9 is stopped. More specifically, a light sensor or the like is disposed in a position where the rear end of the document 9 can be sensed, thereby to make it possible to sense the length of the document 9 before the document 9 starts to be conveyed.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A copying machine comprising:

a document conveying path in which a document is conveyed;

document conveying means capable of moving the document forward and backward in said document conveying path;

document scanning means, fixedly disposed at a predetermined position relative to the document conveying path, for scanning the document during a process in which the document is moved forward in said document conveying path;

paper feeding means for feeding strip-shaped continuous copy paper in synchronization with the forward movement of the document by said document conveying means;

image forming means for forming a copy image of the document on the copy paper fed by said paper feeding means based on the scanning of the document by said document scanning means;

means for carrying out control such that said document conveying means alternately moves the document forward and backward when a plurality of copies are made from the same document;

document length sensing means, including sensing means for sensing timing of when the forward movement of the document is terminated, for sensing a length of the document based on the timing sensed by said sensing means when the document is first moved forward in said document conveying path;

storing means for storing the length of the document sensed by said document length sensing means; and cutting means for cutting said copy paper carrying a copy image corresponding to the first copy at the timing set based on the timing sensed by said sensing means, and for cutting said copy paper carrying the copy image corresponding to a second and subsequent copies at the timing set based on the length of the document stored in said storing means, when a plurality of copies are made from the same document.

2. The copying machine according to claim 1 wherein said document scanning means is a light source for illuminating the document.

3. The copying machine according to claim 2 wherein said image forming means comprise a photoreceptor on which an electrostatic latent image is formed by being exposed to light reflected from the document, a developing device for developing the electrostatic latent image formed on the photoreceptor into a toner image, and a transferring corona discharger for transferring the toner image to the copy paper.

4. The copying machine according to claim 1 wherein said strip-shaped continuous copy paper is rolled-paper wound in a roll shape.

5. A copying machine comprising:

a document conveying path in which a document is conveyed;

document conveying means capable of conveying the document by switching a direction in which the document is conveyed in said document conveying path to a forward direction or a reverse direction;

document scanning means for scanning the document during a process in which the document is conveyed in said document conveying path in the forward direction;

paper feeding means for feeding strip-shaped continuous copy paper in synchronization with the conveyance of the document in the forward direction by said document conveying means;

image forming means for forming a copy image of the document on the copy paper fed by said paper feeding means based on the scanning of the document by said document scanning means;

means for carrying out control such that said document conveying means conveys the document by alternately switching the direction in which the document is conveyed between the forward direction and the reverse direction when a plurality of copies are made from the same document;

document length sensing means, having a sensor disposed in a predetermined position of the document conveying path for sensing a rear end of the document, and a timer for measuring a time elapsed from a start of a copying operation until the sensor senses the rear end of the document, for sensing a length of the document based on the time measured by the timer when the document is first conveyed in said document conveying path in the forward direction;

storing means for storing the length of the document sensed by said document length sensing means; and cutting means for cutting said copy paper at the time set based on the length of the document stored in said storing means when a plurality of copies are made from the same document.

6. The copying machine according to claim 5 wherein said document is conveyed with it being held by a carrier sheet having a double transparent sheet member, and said sensor can sense the rear end of the document in the carrier sheet.

7. The copying machine according to claim 5 wherein said cutting means operate at the timing set on the basis of the timing at which said sensor senses the rear end of the document when an operation of making the first copy is performed.

8. A copying machine comprising:

a document conveying path in which a document is conveyed;

document conveying means capable of conveying the document by switching a direction in which the document is conveyed in said document conveying path to a forward direction or a reverse direction;

document scanning means for scanning the document during a process in which the document is conveyed in said document conveying path in the forward direction;

paper feeding means for feeding strip-shaped continuous copy paper in synchronization with the conveyance of the document in the forward direction by said document conveying means;

image forming means for forming a copy image of the document on the copy paper fed by said paper feeding means based on the scanning of the document by said document scanning means;

means for carrying out control such that said document conveying means conveys the document by alternately switching the direction in which the document is conveyed between the forward direction and the reverse direction when a plurality of copies are made from the same document;

document length sensing means, having a switch provided in a predetermined position of the document conveying path for sensing a presence or an absence of the document in the predetermined position, and a timer for measuring a time length during which the switch continuously senses the document, for sensing a length of the document based on the time measured by the timer when the document is first conveyed in said document conveying path in the forward direction;

storing means for storing the length of the document sensed by said document length sensing means; and cutting means for cutting said copy paper at the time set based on the length of the document stored in said storing means when a plurality of copies are made from the same document.

9. A method of cutting rolled-paper in a copying machine, comprising the steps of:

moving a document forward so as to make a first copy;

scanning the document by document scanning means fixedly disposed during a process in which the document is moved forward;

forming a copy image of the document and transferring the copy image to rolled-paper based on the scanning of the document;

sensing a timing at which the forward movement of the document is terminated;

calculating a length of the document based on the sensed timing at which the forward movement of the document is terminated;

cutting the rolled-paper at the timing set based on the sensed timing at which the forward movement of the document is terminated;

moving the document backward so as to position the document to make a second and subsequent copies;

moving the document forward again so as to make the second and subsequent copies;

scanning the document by the document scanning means fixedly disposed in the process in which the document is moved forward;

forming a second or subsequent copy image of the document and transferring the copy image to the rolled-paper based on the scanning of the document; and cutting the rolled-paper having the copy image corresponding to the second and subsequent copies transferred thereto to lengths equal to the length of the document calculated based on the timing, which is sensed when the document is moved forward so as to make the first copy, at which the forward movement of the document is terminated.

* * * * *